US006732646B2

(12) United States Patent
Zink

(10) Patent No.: US 6,732,646 B2
(45) Date of Patent: May 11, 2004

(54) PUMP INKING UNIT

(75) Inventor: Wolfgang Peter Zink, Obertheres (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/181,946

(22) PCT Filed: Dec. 12, 2000

(86) PCT No.: PCT/DE00/04427

§ 371 (c)(1),
(2), (4) Date: Aug. 1, 2002

(87) PCT Pub. No.: WO01/58690

PCT Pub. Date: Aug. 16, 2001

(65) Prior Publication Data

US 2003/0010237 A1 Jan. 16, 2003

(30) Foreign Application Priority Data

Feb. 10, 2000 (DE) ..... 100 05 876

(51) Int. Cl.[7] ..... B41F 31/08
(52) U.S. Cl. ..... 101/366; 417/360; 417/375
(58) Field of Search ..... 101/366, 350.6, 101/364, 350.1; 417/360, 395, 375, 319, 413.1; 464/29

(56) References Cited

U.S. PATENT DOCUMENTS

| | | | | | |
|---|---|---|---|---|---|
| 3,987,727 | A | * | 10/1976 | Thatcher | 101/366 |
| 4,372,208 | A | | 2/1983 | Legardinier | |
| 4,406,591 | A | * | 9/1983 | Louis | 417/363 |
| 4,998,475 | A | | 3/1991 | John et al. | |
| 5,027,706 | A | * | 7/1991 | Niemiro et al. | 101/366 |
| 5,104,299 | A | * | 4/1992 | Mizuno et al. | 417/417 |
| 5,140,901 | A | * | 8/1992 | John | 101/366 |
| 5,343,805 | A | * | 9/1994 | Lovenbrant et al. | 101/366 |
| 6,318,259 | B1 | * | 11/2001 | Chou et al. | 101/350.5 |

FOREIGN PATENT DOCUMENTS

| | | |
|---|---|---|
| DE | 38 32 183 C1 | 2/1990 |
| DE | 91 00 535.3 | 9/1991 |
| DE | 93 01 147.4 | 8/1993 |

* cited by examiner

*Primary Examiner*—Andrew H. Hirshfeld
*Assistant Examiner*—Leo T. Hinze
(74) *Attorney, Agent, or Firm*—Jones, Tullar & Cooper, PC

(57) ABSTRACT

An ink pump for a punp inking unit of a rotary printing press utilizes a two piece coupling between the ink pump and an ink pump drive unit. The ink pump is part of a replaceable inking unit while the ink pump drive unit is supported in the frame of the press. The two piece coupling operatively connects the ink pump and the ink pump drive unit. Each piece of the coupling is a permanent magnet. These engage in a non-positive fit to provide a robust coupling.

5 Claims, 1 Drawing Sheet

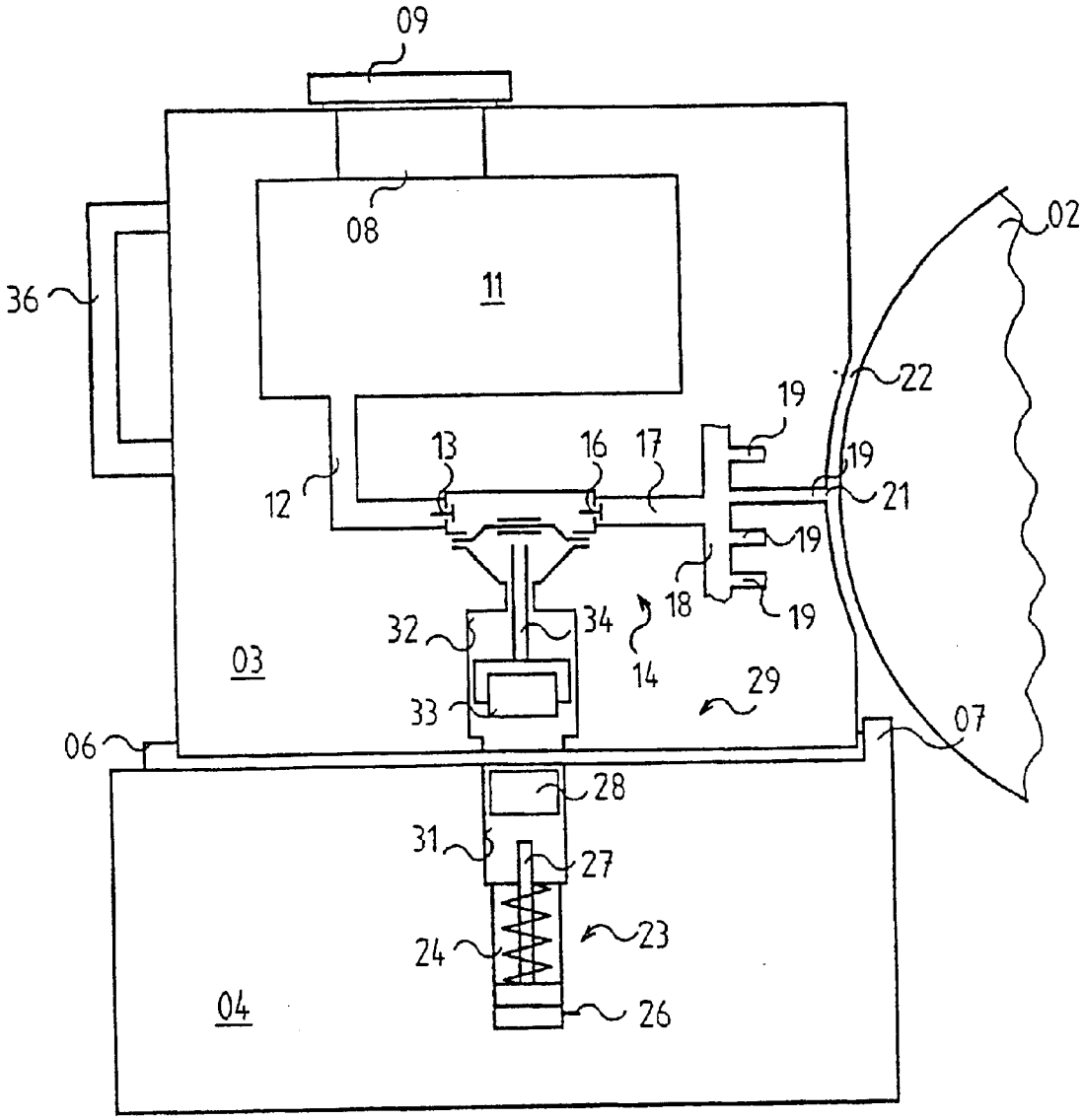
09
08
11
36
02
22
19
13
16
17
19
21
12
19
18
19
32
34
14
03
29
33
07
06
28
31
27
23
24
26
04

PUMP INKING UNIT

FIELD OF THE INVENTION

The present invention is directed to a pump inking unit of a rotary printing press.

BACKGROUND OF THE INVENTION

DE 91 00 535 U1 discloses a pump unit for supplying fluid substances to a printing or coating machine. A component unit, which can be removed in one piece, is at least comprised of a pump, a pump drive unit, and a reservoir.

DE 38 32 183 C1 discloses a pump unit with a replaceable ink fountain and a pump. A pump drive unit and the pump can be coupled by the use of an electromagnetic coupling.

SUMMARY OF THE INVENTION

The object of the present invention is to provide an ink pump for a pump inking unit of a rotary printing press.

The object of the present invention is attained by the provision of a pump inking unit which has one or more replaceable inking units, each of which has a reservoir and an ink pump. A pump drive unit for the pump inking unit has a first coupling part. Each inking unit's ink pump has a second coupling part. The two coupling parts execute a linear oscillating motion during operation.

The advantages that can be achieved with the pump inking unit of the present invention are comprised particularly in the fact that the replaceable ink fountain of the pump inking unit is only associated with the components, which are absolutely required for the inking. For this reason, at least the drive unit for the ink pump is disposed in the cross beam that is fastened to the lateral frames. The coupling between the drive unit disposed in the cross beam and the ink pump disposed in the ink fountain is ruggedly designed so that contaminations due to ink and the like cannot impair the force transmission of the pump drive unit.

BRIEF DESCRIPTION OF THE DRAWINGS

A preferred embodiment of the present invention is shown in the drawing and will be described in detail below. The sole FIGURE schematically depicts a cross section through a pump inking unit with a traveling inking unit, which is a fraction of the width of the paper web and is disposed on a cross beam fastened to the lateral side frames of the printing or coating machine.

DESCRIPTION OF THE PREFERRED EMBODIMENT

A pump inking unit 01 is depicted schematically in FIG. 1 and is comprised of one or more, preferably four, slidable or movable inking units 03 which are disposed next to one another in a direction axially parallel to an inking roller 02 having a roller width which corresponds to the width of the printing press. The inking units 03 are disposed on a cross bar or beam 04 that extends in an axially parallel direction between the lateral side frames of the printing press. The inking units 03 are supported so that they can slide in the radial direction of the inking roller 02. The inking units 03 are each disposed or supported on profiled rails 06, which profiled rails 06 extend on the cross bar or beam 04, lateral to its longitudinal axis. At their ends oriented toward the inking roller 02, the profiled rails 06 affixed to the cross bar or beam 04 each have a stop 07 which acts to limit the insertion movement of each of the inking units 03 toward the inking roller 02. Each profiled rail 06 includes an assembly, not shown, for locking the inserted inking unit 03 in place.

Each replaceable or traveling inking unit 03 has an ink reservoir 11 that can be filled through an opening 08 which can be closed by a cover 09.

The ink reservoir 11 is connected, by a discharge line 12 and a check valve 13, to the inlet of an ink pump disposed in the inking unit 03. The ink pump may be, for example, a diaphragm pump 14. The outlet of the diaphragm pump 14, in turn, is connected to a distributor line 18 by a check valve 16 and a supply line 17.

The distributor line 18 for each quarter-width inking unit 03 extends axially parallel to the inking roller 02 and has a number of three to ten, and preferably five, outlet lines 19 which are spaced apart from one another. The outlet lines 19 extend parallel to one another in the radial direction of the inking roller 02 and each feed, via an outlet opening 21, into an arc-shaped annular gap 22, which the circumferential surface for the inking roller 02 passes through. It will be understood that the outlet lines 19 are shown in the sole drawing FIGURE rotated 90° out of their proper orientation for purposes of improved illustration.

A pump drive unit 23 is disposed in the cross bar or beam 04 and is comprised, for example, of a pneumatically actuated working cylinder 24, which is supplied, at intervals, with compressed air by a supply fitting 26. At its end remote from the working cylinder 24, a piston rod 27, which is disposed in the cylinder has a first permanent magnet 28 which is part of a two-part coupling 29, which can be moved back and forth in a vertically extending guide, such as a bore 31, of the cross bar or beam 04 during operation. Stated differently, the two part coupling 29 executes an oscillating motion. The bore 31 in the cross bar or beam 04 is disposed directly opposite, and below, a guide or bore 32 which is disposed in the replaceable inking unit 03 so that the two bores 31 and 32 are aligned with each other.

A second permanent magnet 33, which is polarized in opposition to the first permanent magnet 28, is disposed in the bore 32 of the replaceable inking unit 03. This second magnet 28 is affixed to an end of a piston rod 34 of the diaphragm pump 14 at the end of the piston rod 34 remote from the diaphragm of the diaphragm pump 14.

It is also possible to use a double-action working cylinder, a crank mechanism, or a so-called sliding block mechanism as a pump drive unit 23.

The pump inking unit 01 in accordance with the present invention functions as follows:

After an ink reservoir 11 has been filled with printing ink, the inking unit 03, which, for example may be provided with handles 36, is placed onto the profiled rails 06, is slid against the stop 07, and is locked in place. By actuating the pump drive unit 23, the permanent magnets 28 and 33 of the two part coupling 29 are connected to each other in a frictionally engaging manner. The diaphragm pump 14 is driven by the pump drive unit 23 through the coupling 29 and sends the printing ink into the distributor line 18 and consequently into the outlet lines 19. The ink flows through the outlet openings 21 into the annular gap 22, and onto the circumferential surface of the inking roller 02.

A metering valve, which is not specifically depicted in the sole drawing FIGURE, can also be provided for each outlet opening 21.

While a preferred embodiment of a pump inking unit in accordance with the present invention has been set forth fully and completely hereinabove, it will be apparent to one of skill in the art that various changes in, for example, the drive for the inking roller, the type of ink being pumped and the like could be made without departing form the true spirit and scope of the present invention which is to be limited only by the following claims.

What is claimed is:

1. A pump inking unit of a rotary printing press comprising:

at least one replaceable inking unit supportable in the rotary printing press, said at least one replaceable inking unit having an ink reservoir;

an ink pump in said at least one replaceable inking unit and connected to said ink reservoir of said at least one replaceable inking unit;

an ink pump drive unit separate from said at least one replaceable inking unit, said ink pump drive unit having a first coupling part, said first coupling part being a first permanent magnet; and a second coupling part connected to said ink pump in said at least one replaceable inking unit, said second coupling part being a second permanent magnet, said first and said second permanent magnets each being supported for executing a linear oscillating motion during operation of said ink pump drive unit, said linear oscillating motions of said first and said second permanent magnets being usable to drive said ink pump.

2. The pump inking unit of claim 1 wherein said ink pump is a diaphragm pump.

3. The pump inking unit of claim 1 wherein said ink pump drive unit is a working cylinder.

4. The pump inking unit of claim 1 further including a plurality of ink outlet openings for said at least one inking unit.

5. The pump inking unit of claim 1 further including a cross bar disposed between lateral side frames of the rotary printing press and wherein said ink pump drive unit is disposed in said cross bar.

* * * * *